US009466889B2

(12) United States Patent
Patel

(10) Patent No.: US 9,466,889 B2
(45) Date of Patent: Oct. 11, 2016

(54) TRACKING ANTENNA SYSTEM ADAPTABLE FOR USE IN DISCRETE RADIO FREQUENCY SPECTRUMS

(71) Applicant: Trushar D. Patel, Hercules, CA (US)

(72) Inventor: Trushar D. Patel, Hercules, CA (US)

(73) Assignee: Sea Tel, Inc., Concord, CA (US)

( * ) Notice: Subject to any disclaimer, the term of this patent is extended or adjusted under 35 U.S.C. 154(b) by 0 days.

(21) Appl. No.: 14/147,526

(22) Filed: Jan. 4, 2014

(65) Prior Publication Data

US 2015/0222024 A1 Aug. 6, 2015

Related U.S. Application Data

(60) Provisional application No. 61/749,237, filed on Jan. 4, 2013.

(51) Int. Cl.

| | |
|---|---|
| ***H01Q 19/10*** | (2006.01) |
| ***H01Q 19/17*** | (2006.01) |
| ***H01Q 1/42*** | (2006.01) |
| ***H01Q 1/12*** | (2006.01) |
| ***H01Q 3/08*** | (2006.01) |
| ***H01Q 19/13*** | (2006.01) |

(52) U.S. Cl.

CPC ..... *H01Q 19/17* (2013.01); *H01Q 1/1257* (2013.01); *H01Q 1/42* (2013.01); *H01Q 3/08* (2013.01); *H01Q 19/13* (2013.01); *Y10T 29/49016* (2015.01)

(58) Field of Classification Search

CPC ..... H01Q 19/10; H01Q 19/17; H01Q 1/42
USPC ..... 343/835, 840, 872, 765
See application file for complete search history.

(56) References Cited

U.S. PATENT DOCUMENTS

| | | | | |
|---|---|---|---|---|
| 2,572,919 | A | 10/1951 | French et al. | |
| 3,427,626 | A | 2/1969 | Losee | |
| 4,562,441 | A | 12/1985 | Beretta et al. | |
| 6,292,142 | B1 * | 9/2001 | Pittman | F16B 7/20 343/700 MS |
| 9,000,995 | B2 * | 4/2015 | Blaney | H01Q 25/00 248/550 |
| 2003/0052833 | A1 | 3/2003 | Chang et al. | |
| 2010/0149059 | A1 | 6/2010 | Patel | |
| 2011/0012801 | A1 | 1/2011 | Monte et al. | |
| 2011/0283322 | A1 | 11/2011 | Hamano | |
| 2014/0152492 | A1 * | 6/2014 | Zimmerman | H01Q 15/162 342/352 |

* cited by examiner

*Primary Examiner* — Hoang V Nguyen
(74) *Attorney, Agent, or Firm* — Morgan, Lewis & Bockius LLP

(57) ABSTRACT

A tracking antenna system for discrete radio frequency spectrums includes a reflector, a pedestal supporting the reflector, a radome assembly enclosing both, a first feed for gathering radio waves within a first of discrete RF spectrums that is removably disposed in front of the reflector at the focal point, a first RF module operably connected to the first feed for converting the first gathered radio waves to first electronic signals, a feed mount for removably supporting the first feed and configured to removably support a second feed for gathering radio waves within a second of discrete RF spectrums, and a module mount for removably supporting the first RF module and configured to removably support a second RF module for converting the second radio waves to second electronic signals. A method of using the tracking antenna system adaptable for discrete radio frequency spectrums is also disclosed.

21 Claims, 13 Drawing Sheets

TRACKING ANTENNA SYSTEM ADAPTABLE FOR USE IN DISCRETE RADIO FREQUENCY SPECTRUMS

The present invention claims the benefit under 35 U.S.C. §119 to U.S. Provisional Application No. 61/749,237 filed Jan. 4, 2013, the entire contents of which is incorporated herein by this reference.

BACKGROUND OF INVENTION

1. Field of Invention

This application relates, in general, to a tracking antenna system adaptable for use in discrete radio frequency spectrums, and more particularly to a tracking antenna system adaptable for use in C, Ku and Ka satellite communication bands, as well as methods of using the same.

2. Description of Related Art

Radio frequency for satellite communication ranges approximately from 1 GHz to 40 GHz, as shown in FIG. 13. Normally, C and Ku bands are used for digital TV transmission and Ka band for high-speed internet access. This is due to the fact that attenuation caused by rain or other environmental factors increases with frequency, thus Ka band is more sensitive to the weather and other factors. As C and Ku bands become increasingly depleted and/or congested, communication using Ka band, including satellite communication for digital TV transmission and very small aperture terminal (VSAT) networking, is under rigorous development. Comparing to C and Ku bands, Ka band (including K band) provides much wider frequency range for use, extending from approximately 18 to 40 GHz.

However, existing antenna systems for receiving and converting signals from a satellite are designed and tuned in accordance with the specific radio frequency (RF) spectrum of the targeted satellite. As such, an antenna system configured for use with one spectrum will not work properly with another spectrum. For example, an antenna system configured for use with C band or Ku band cannot be used in Ka band, or vice verse. In order to receive and/or convert signals from another satellite in a different RF spectrum, the entire antenna system has to be replaced by another antenna system specifically configured for the newly desired spectrum. Replacement of an entire system is expensive, sometime may not be affordable, as an antenna system and particularly a maritime antenna system typically costs tens of thousands dollars.

Alternatively, a system having multi-antennas in a single radome has been developed to communicate in multiple RF spectrums. The multi-antenna system basically configures each of the antennas in accordance with one of the targeted satellites. An exemplar of such multi-antenna systems can be found in U.S. Patent Application Publication No. 2009/0009416 to Blalock.

Although it can receive signals in two or more RF spectrums, a multi-antenna system has several disadvantages. It is generally larger and requires a significant mounting space and/or a larger footprint, which may not available under certain circumstances. It is heavier and thus place considerable challenges on positioning and stabilizing a system since an antenna system has to be continuously and accurately directed towards the targeted satellite in order to function properly. In addition, it is more expensive than a single antenna system.

In light of the foregoing, it would be useful to provide an antenna system and method using the same, which overcome the above and other disadvantages.

BRIEF SUMMARY

One aspect of the present invention is directed to a tracking antenna system for use in a plurality of discrete radio frequency (RF) spectrums, the antenna system including a reflector for reflecting radio waves to a focal point, a pedestal for supporting the reflector about a plurality of axes, a radome assembly enclosing the reflector and the pedestal, the radome assembly being substantially transparent to radio waves within the plurality of discrete RF spectrums, a first feed for gathering radio waves traveling from the reflector within a first of discrete RF spectrums, the first feed being removably disposed in front of the reflector at the focal point, a first RF module operably connected to the first feed for converting the gathered radio waves within the first of discrete RF spectrums to first electronic signals, a feed mount for removably supporting the first feed, wherein the feed mount is dimensioned and configured to removably support a second feed for gathering radio waves within a second of discrete RF spectrums, and a module mount for removably supporting the first RF module, wherein the module mount is dimensioned and configured to removably support a second RF module for converting radio waves within the second of discrete RF spectrums to second electronic signals.

The module mount may be on the reflector. The feed mount may be on the reflector. The module mount may include a protrusion extending from the reflector for allowing the first or second RF module be hung therefrom. The pedestal may support the reflector about three axes. The three axes may include an azimuth axis, a cross-level axis, and an elevation axis.

The tracking antenna system may further include a cylinder assembly for damping vertical vibrations, the cylinder assembly may be connected to the pedestal via a universal joint. The universal joint may be a ball joint.

The radome assembly may includes a base having a pedestal mount for supporting the pedestal and a peripheral mount, and a radome body including a dome section, a substantially cylindrical waist section, and a flange extended from the waist section and removably secured to the peripheral mount of the base, wherein the dome section is substantially a sphere truncated a less half therefrom, and is tuned to be substantially transparent to the radio waves within the plurality of discrete RF spectrums.

The waist section may be configured to have a transition section formed of a plurality of plies for enhancing a strength of the radome body, wherein a leading edge of one ply may be positioned ahead of or behind a leading edge of another ply immediately adjacent the one ply. The radome body may be formed monolithically. The base further includes a hatch for accessing an interior of the dome assembly.

The first of discrete RF spectrums may be a Ku band or a C band. The second of discrete RF spectrums may be a Ka band.

The first RF module may include a first Orthomode Transducer (OMT), a first diplexer, a first Block Upconverter (BUC), a first Low Noise Block-downconverter (LNB), a first filter, a first Polarity Angle (Polang) motor, and/or a first waveguide. The second RF module may include a second OMT, a second diplexer, a second BUC, a second LNB, a second filter, a second Polang motor, and/or a second waveguide. The first RF module may be configured for use with a first Media Exchange Points (MXP) connected to a digital antenna control unit (DAC), and the second RF module may be configured for use with a second MXP, for displaying signals in different formats include vocal and/or visual forms.

Another aspect of the present invention is directed to a method of converting a tracking antenna system for use in a plurality of discrete radio frequency (RF) spectrums, the method including removing a first feed from a feed mount, wherein the first feed gathers radio waves within a first of discrete RF spectrums reflected from the reflector, removing a first RF module from a module mount, wherein the first RF module is operably connected to the first feed, and converts the radio waves within the first of discrete RF spectrums to electronic signals, installing a second RF module on the module mount that is dimensioned and configured to removably support the second RF module, and installing a second feed on the feed mount that is dimensioned and configured to removably support the second feed, wherein the second feed gathers radio waves within a second of discrete RF spectrums, and the second RF module converts the radio waves within the second of discreet RF spectrums into second electronic signals.

The first of discrete RF spectrums may be a Ku band or a C band. The second of discrete RF spectrums may be a Ka band. The removing and installing steps may be completed through a hatch on a base of the radome assembly without removing the radome assembly.

The methods and apparatuses of the present invention have other features and advantages which will be apparent from or are set forth in more detail in the accompanying drawings, which are incorporated herein, and the following Detailed Description, which together serve to explain certain principles of the present invention.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 1:
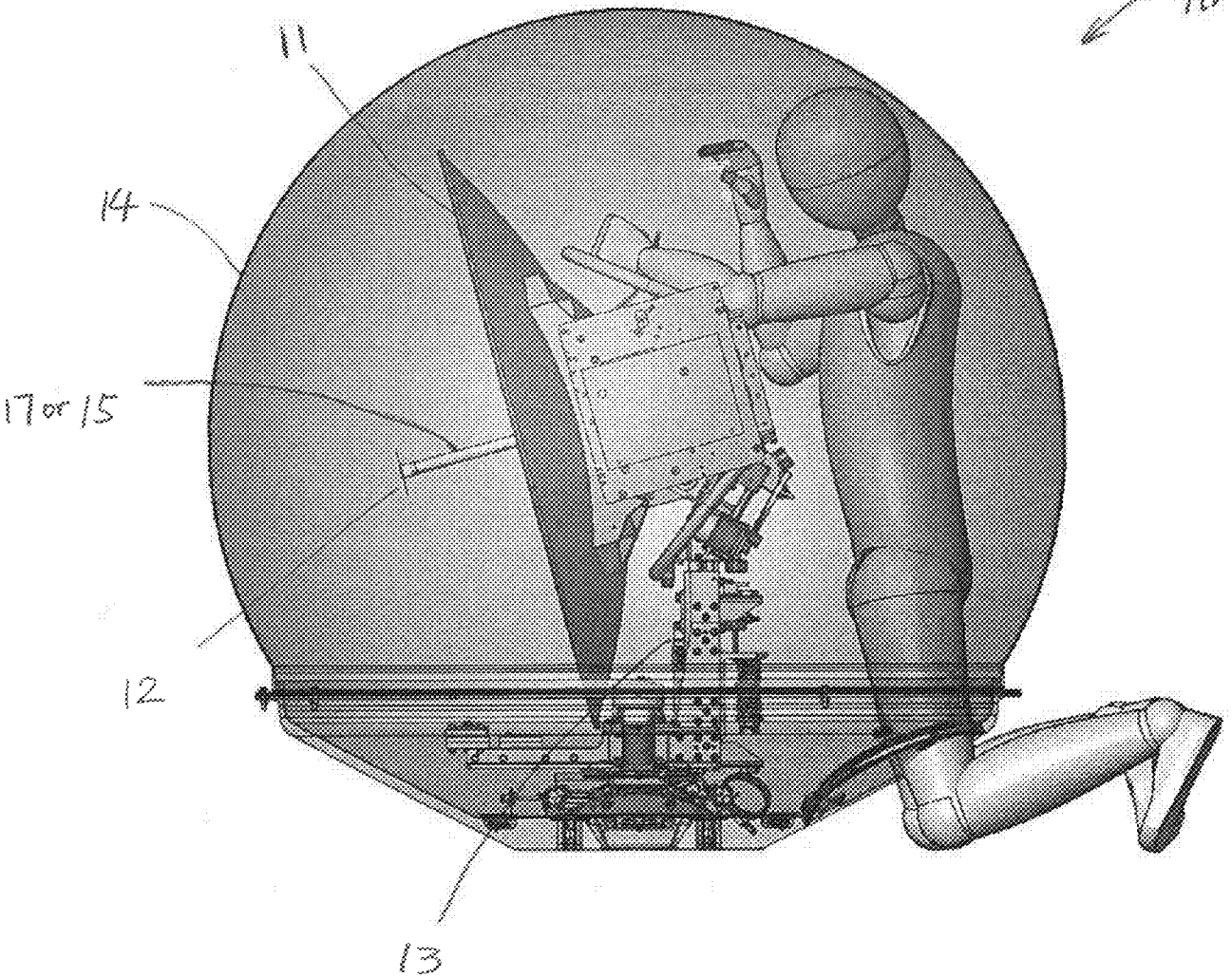
FIG. 1 is a schematic side view of an exemplary tracking antenna system adaptable for discrete radio frequency (RF) spectrums in accordance with various aspects of the present invention.
Figure 2:
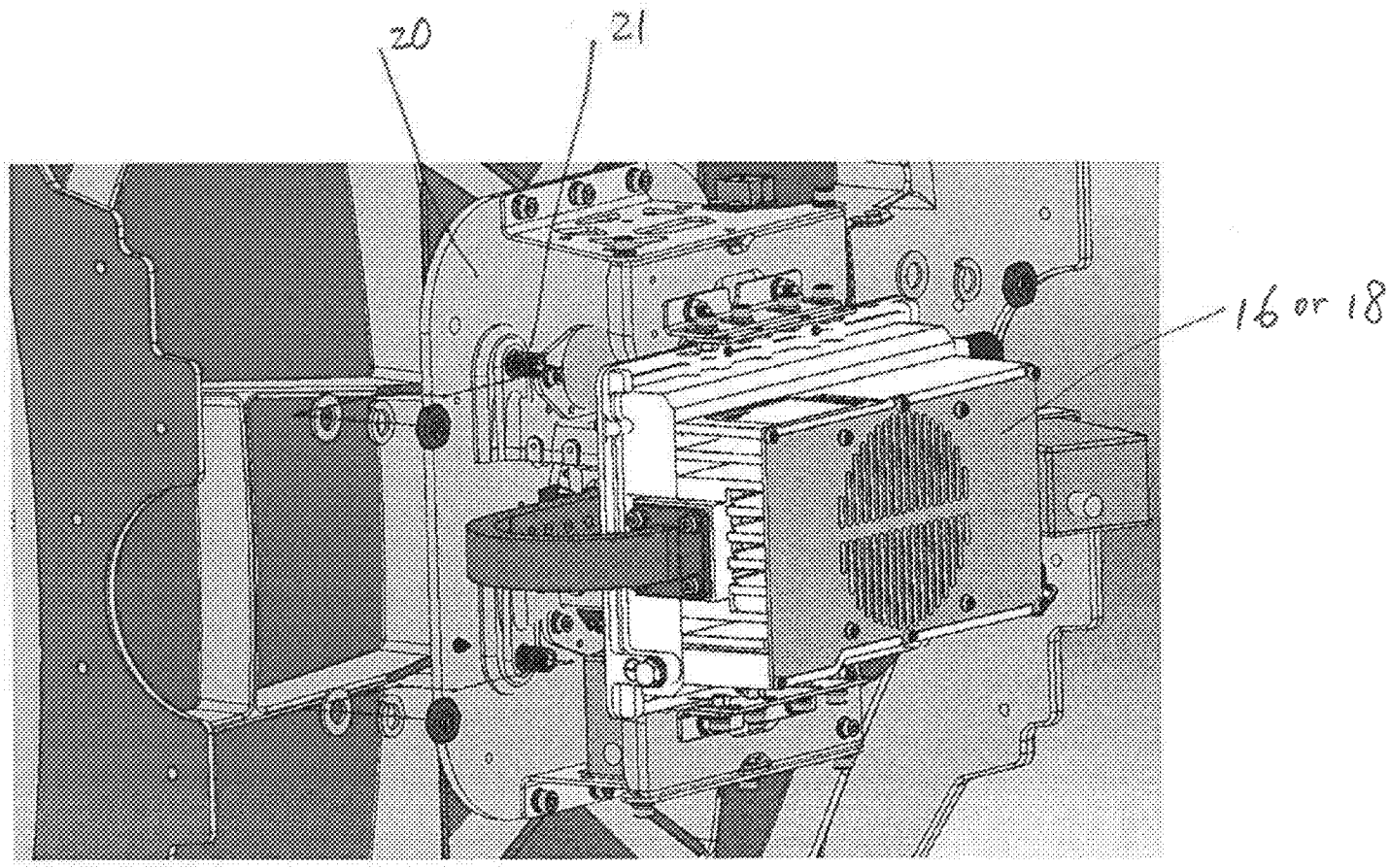
FIG. 2 is an enlarged partial rear perspective view showing an exemplary module and an exemplary module mount

Turning now to the drawings, wherein like components are designated by like reference numerals throughout the various figures, attention is directed to FIGS. 1 and 2, which illustrate a tracking antenna system 10 for use in a plurality of discrete radio frequency (RF) spectrums. The tracking antenna system of the present invention in general includes a reflector 11 for reflecting radio waves to a focal point 12, a pedestal 13 for supporting the reflector about a plurality of axes, and a radome assembly 14 enclosing the reflector and the pedestal. The radome assembly is substantially transparent to radio waves within the plurality of discrete RF spectrums. The tracking antenna system of the present invention also includes a first feed 15 disposed in front of the reflector at the focal point for gathering radio waves traveling from the reflector within a first of discrete RF spectrums, and a first RF module 16 operably connected to the first feed for converting the gathered radio waves to electronic signals.

Figure 3:
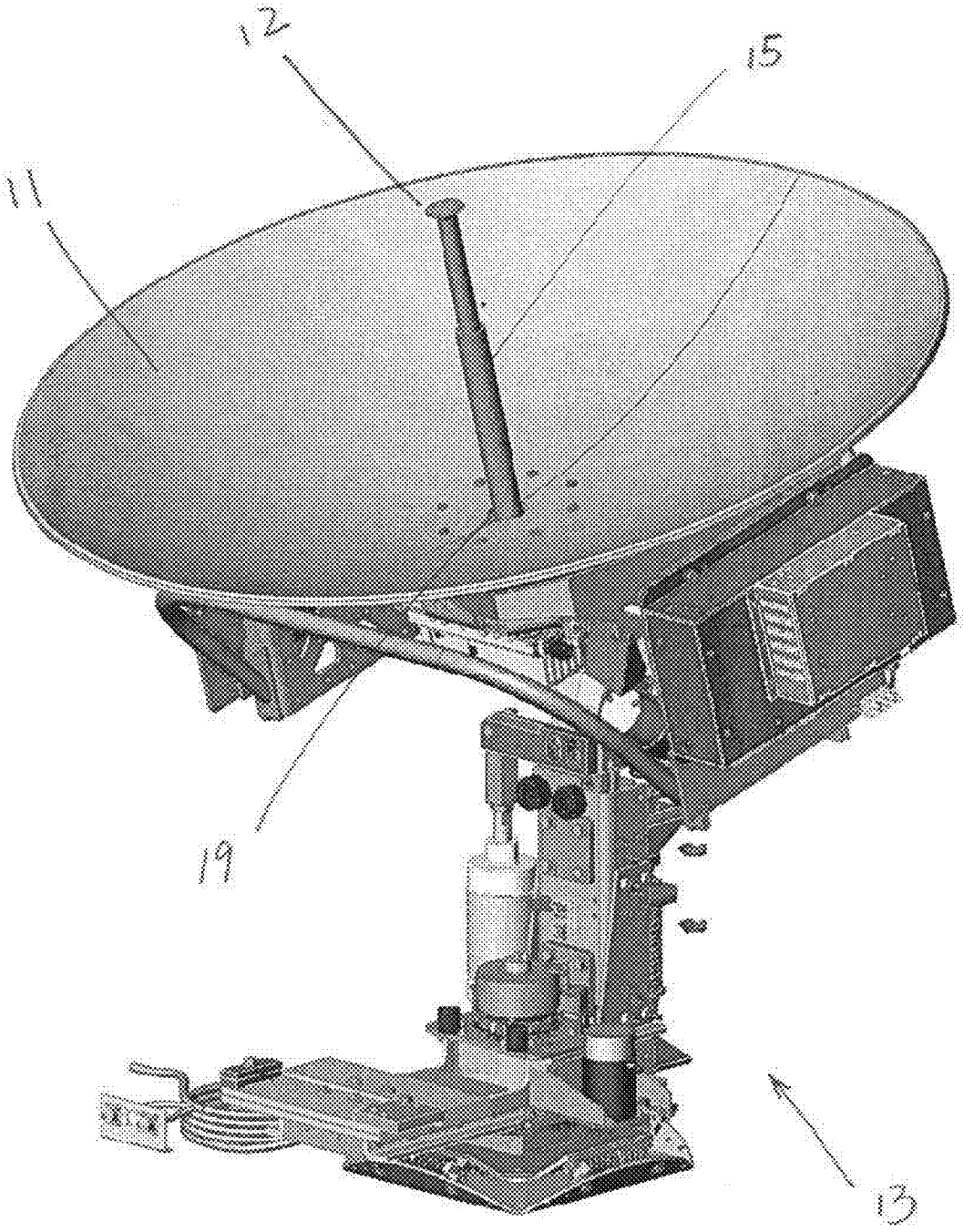
FIG. 3 is a front perspective view of the system of FIG. 1 without the radome assembly.

Referring to FIGS. 2 and 3, the tracking antenna system of the present invention further includes a feed mount 19 for removably supporting the first or second feed, and a module mount 20 for removably supporting the first or second RF module. In various embodiments of the present invention, the module mount is dimensioned and configured to support different RF modules for use in a plurality of discrete RF spectrums. It can be disposed on the reflector, preferably in the back of the reflector. It can also be disposed on the pedestal. In various embodiments of the present invention, the module mount is disposed on the back of the reflector, as shown in FIG. 2.

In various embodiments of the present invention, the module mount 20 includes a plurality of protrusions 21 such that a RF module 16, 18 can hang on the protrusions even after the studs, nuts or other fasteners are removed. Such design provides a useful feature to safeguard the removal and installation of RF modules, and ensures the switching of RF modules is easy and safe.

The feed mount 19 for removably supporting the feed 15, 17 can be formed on the reflector or disposed with the module mounts.

The reflector 11 of the present invention is generally of a circular parabolic structure, similar to those used in the Sea Tel® 6004, 6006 and 6009 Ku and other satellite communications sold by Sea Tel, Inc. of Concord, Calif. One will appreciate that the principles of the present invention, for example, the band adaptability, may be utilized with other suitable reflectors and associated structure.

In order to receive signals from a satellite, the reflector of an antenna system must generally be pointed in the direction toward the satellite. In a mobile application such as an antenna system used on ships, tracking and motion control units are required to continuously and accurately position the reflector in the right direction. The pedestal 13 of the present invention is equipped with such tracking and motion control units for supporting and rotating the reflector about a plurality of axes.

Figure 4:
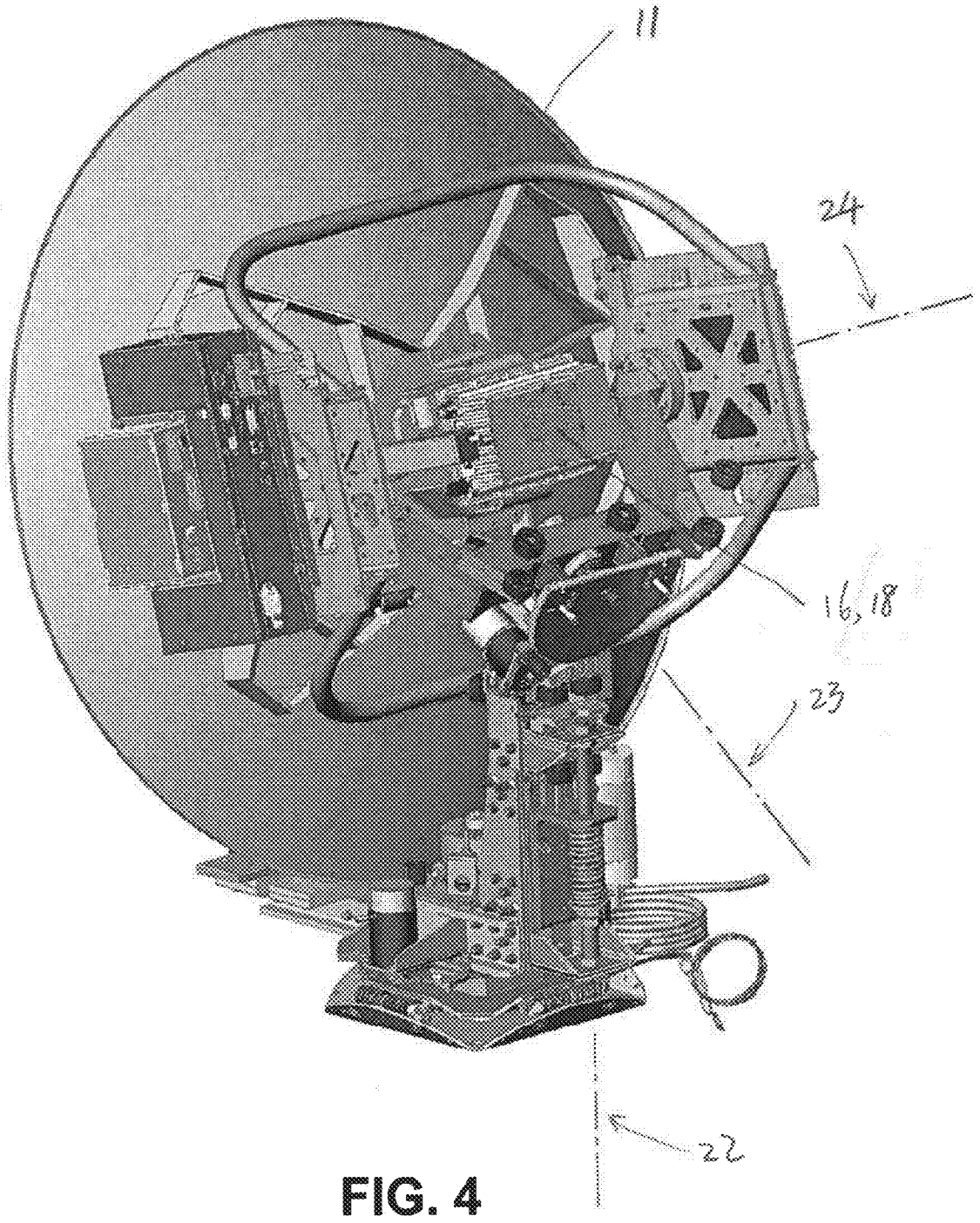
FIG. 4 is a rear perspective view showing an exemplary first RF module mounted on a reflector.

As shown in FIG. 4, the pedestal 13 can align a tracking antenna system about three axes, an azimuth axis 22, a cross-level axis 23, and an elevation axis 24. One will appreciate that the present invention is not limited to the specific axes of the illustration embodiments. In some aspects, the pedestal is similar to those disclosed by U.S. Pat. No. 5,419,521 to Matthews and U.S. Patent Application Publication No. 2010/0149059 to Patel, the entire content of which patent and application, is incorporated herein for all purposes by this reference. One will appreciate that various aspects of the pedestal may be similar to those used in Sea Tel® 6004, 6006 and 6009 Ku and other Sea Tel® Cobham satellite communications antennas sold by Sea Tel, Inc. of Concord, Calif., as well as by other manufactures.

Figure 5:
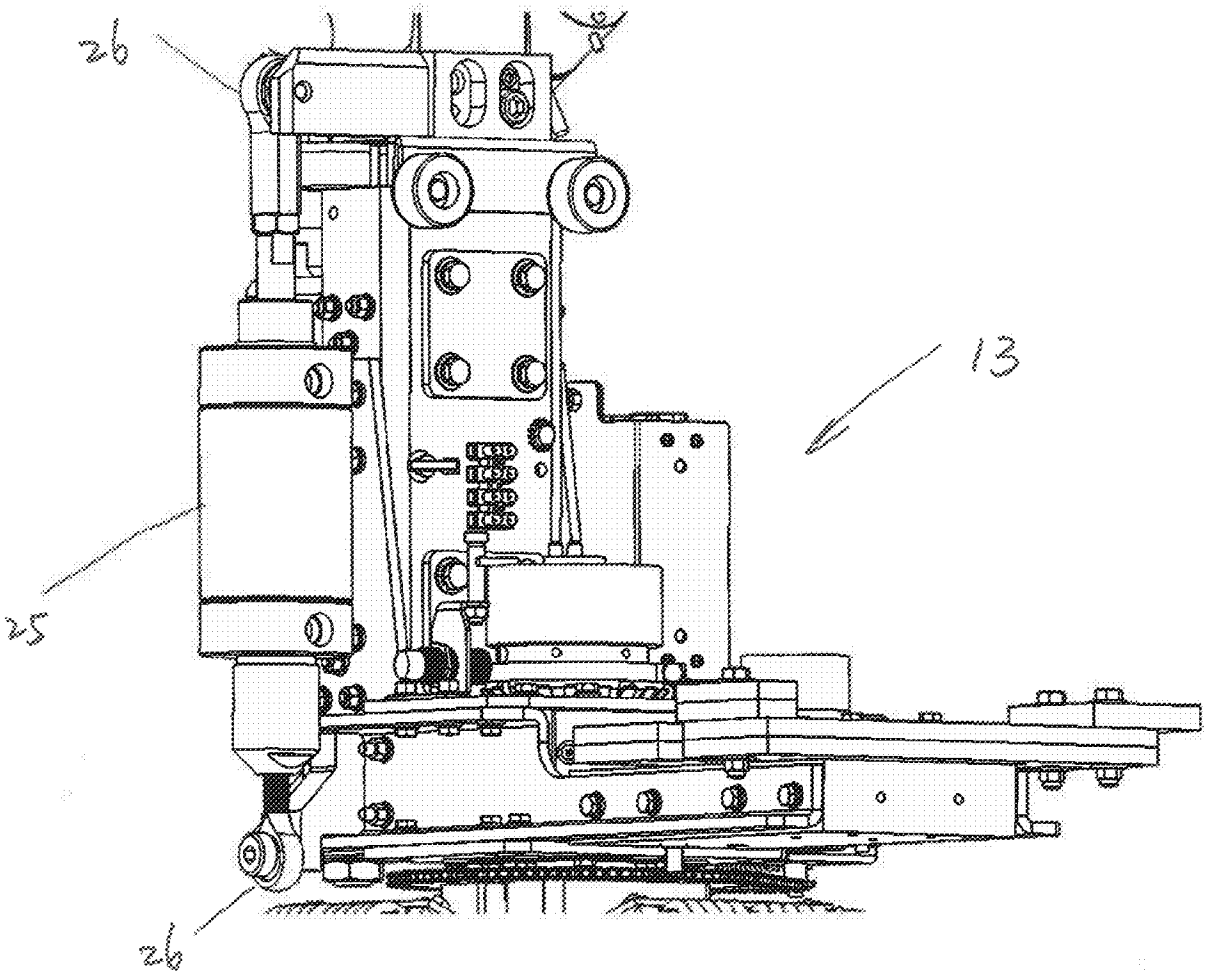
FIG. 5 is a side perspective view showing a cylinder for damping vertical vibrations.

With reference to FIG. 5, a cylinder assembly 25 is provided for damping vertical vibrations while minimizing unintended binding in horizontal directions. The cylinder assembly includes two universal joints 26 that connect the top and bottom of the cylinder assembly to the pedestal 13. In the illustrated exemplary embodiments, the universal joints are ball joints. Such ball-joint connections restrict translational displacement but allow freedom of rotation, thus eliminating horizontal forces and preventing a potential binding. One will appreciate that other connections may be utilized to provide the desired degrees of freedom.

The cylinder assembly 25 of the present invention may be an air cylinder damper. But one will appreciate other types can be used, for example, a hydraulic or oil damper. One will also appreciate that the present invention is not limited to ball joints.

Figure 6:
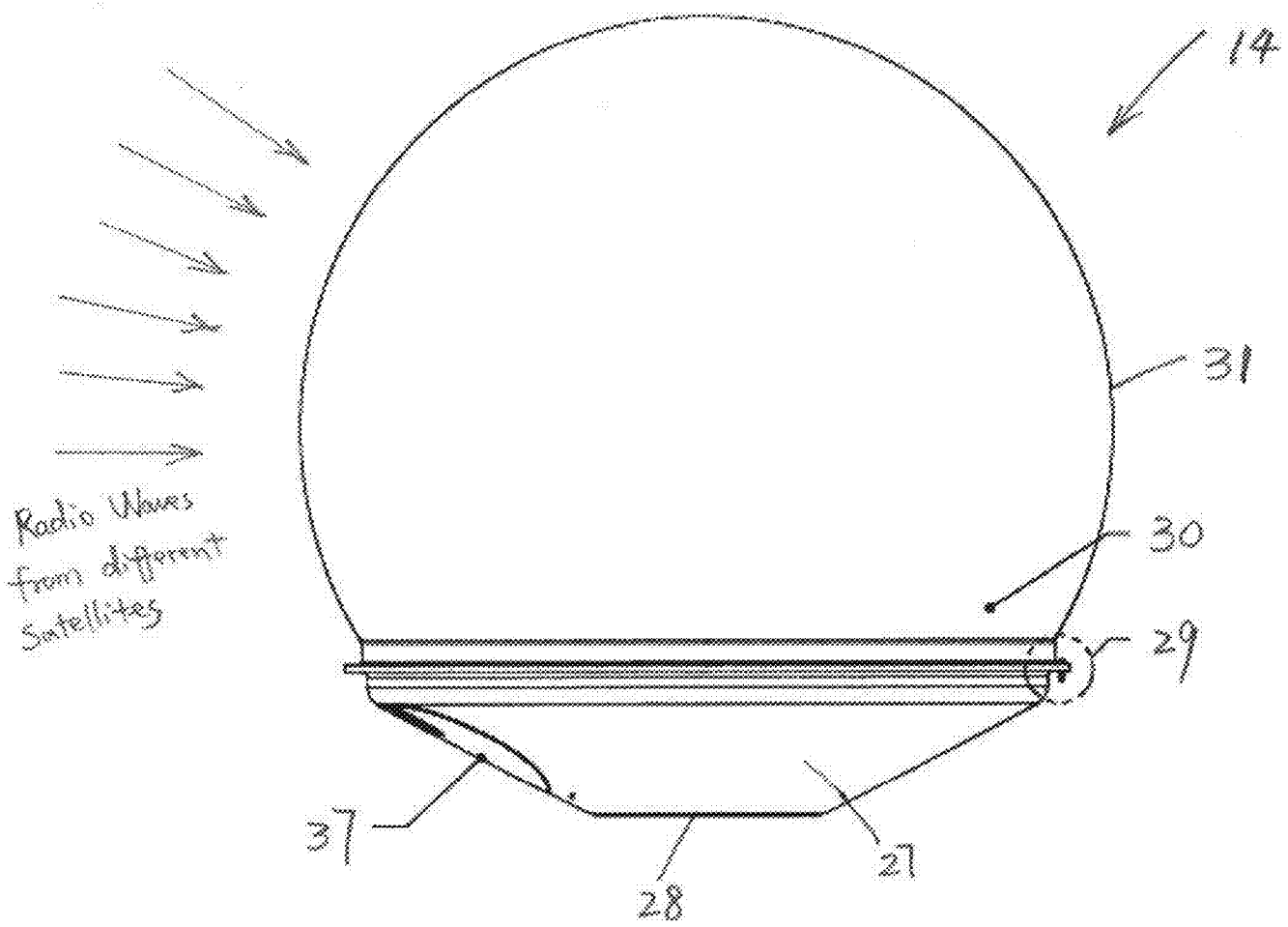
FIG. 6 is a side view of an exemplary radome assembly of the system in accordance with various aspects of the present invention.

Turning now to FIG. 6, a radome assembly 14 of the system in accordance with various embodiments of the present invention includes a base 27 and a radome body 30 having a dome section 31. In some aspects, the radome assembly of the present invention is similar to those disclosed by U.S. Patent Application Publication No. 2010/0295749 to Vanliere, the entire content of which patent and application, is incorporated herein for all purposes by this reference. One will appreciate that various aspects of the radome may be similar to those used in Sea Tel® 6004, 6006 and 6009 Ku and other Sea Tel® Cobham satellite communications antennas sold by Sea Tel, Inc. of Concord, Calif., as well as by other manufactures.

However, the radome assembly 14 of the present invention differs from the above mentioned references in many other aspects. Structurally, the dome section 31 is substantially a larger half of a sphere. That is, the dome section is a substantially spherical structure with a small portion being truncated, resulting the height of the dome section is longer than the radius of substantially spherical structure. Here, the height of the dome section is defined by the distance from the apex of the dome section to the truncation surface. Characteristically, the dome section is configured and tuned to be substantially transparent to the radio waves within a plurality of discrete RF spectrums.

A radome assembly 14 configured as such presents several advantages. Notably, radio waves transmitted by almost any satellite above the horizon, including a satellite stationed at a lower elevation angle, hit the surface of the dome section at a normal incident angle as shown by arrows in FIG. 6. This leads to a minimal or negligible reflection loss of signals. As such, the tracking antenna system of the present invention can function properly in a wide range of elevation angles, from −120 to +120 degrees. In addition, with associated structures and components adapted to function within the plurality of discrete RF spectrums, the tracking antenna system of the present invention can be used to receive signals from different satellites in different RF spectrums.

Figure 7:
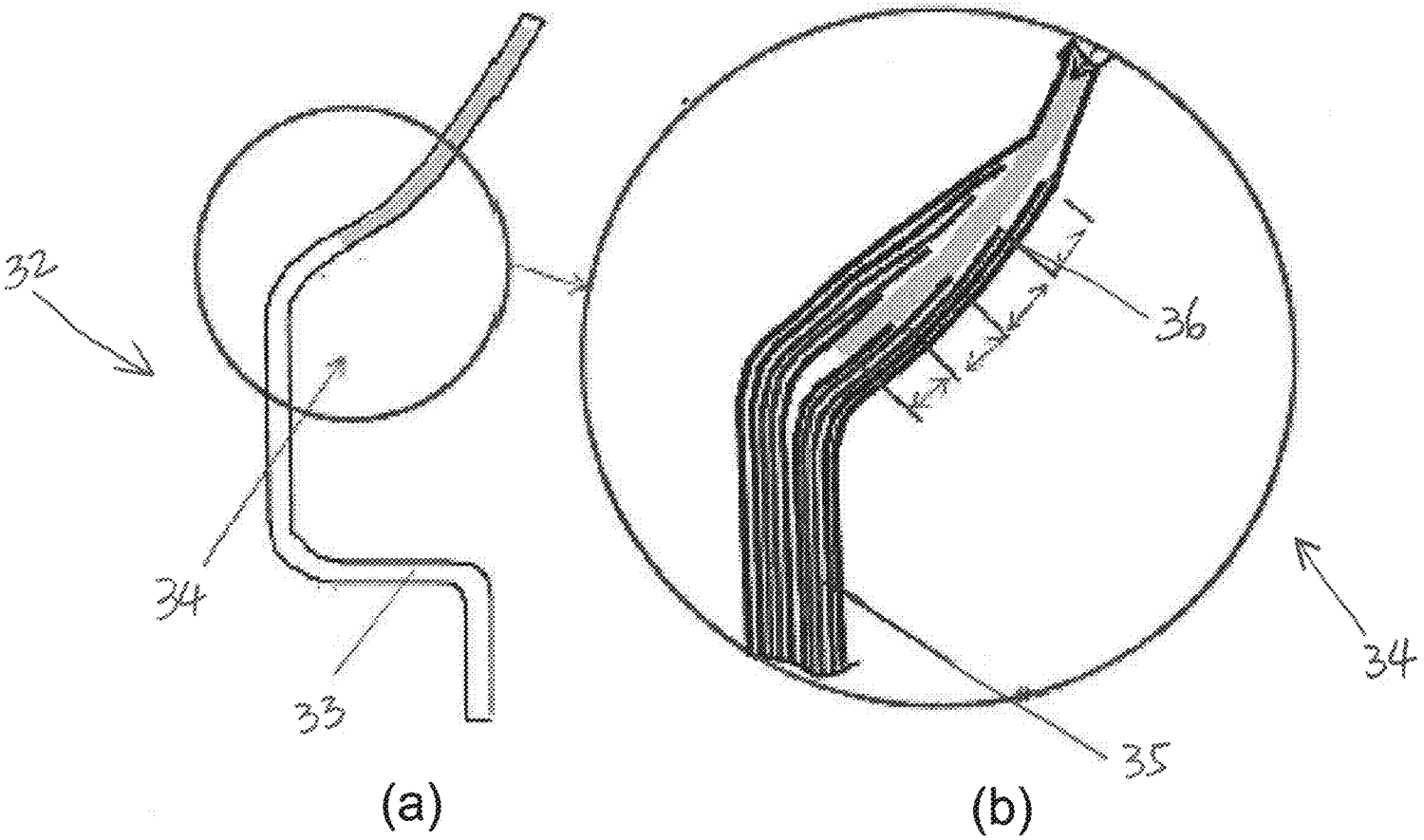
FIGS. 7*a* and 7*b* are enlarged schematic partial views illustrating a transition section of the radome assembly of FIG. 6.

Referring to FIG. 7*a*, the radome body 30 also includes a substantially cylindrical waist section 32 and a flange 33 extended from the waist section. The waist section of various embodiments is configured to have a transition section 34 smoothly linking the substantially spherical dome section with the cylindrical waist section, as shown in FIG. 8*b*. To enhance the strength of the radome body and at the same time minimize the potential blockage of the satellite signals, the transition section is formed of a plurality of plies 35 with a leading edge 36 of one ply positioned ahead of or behind a leading edge of its immediately adjacent ply.

Figure 8:
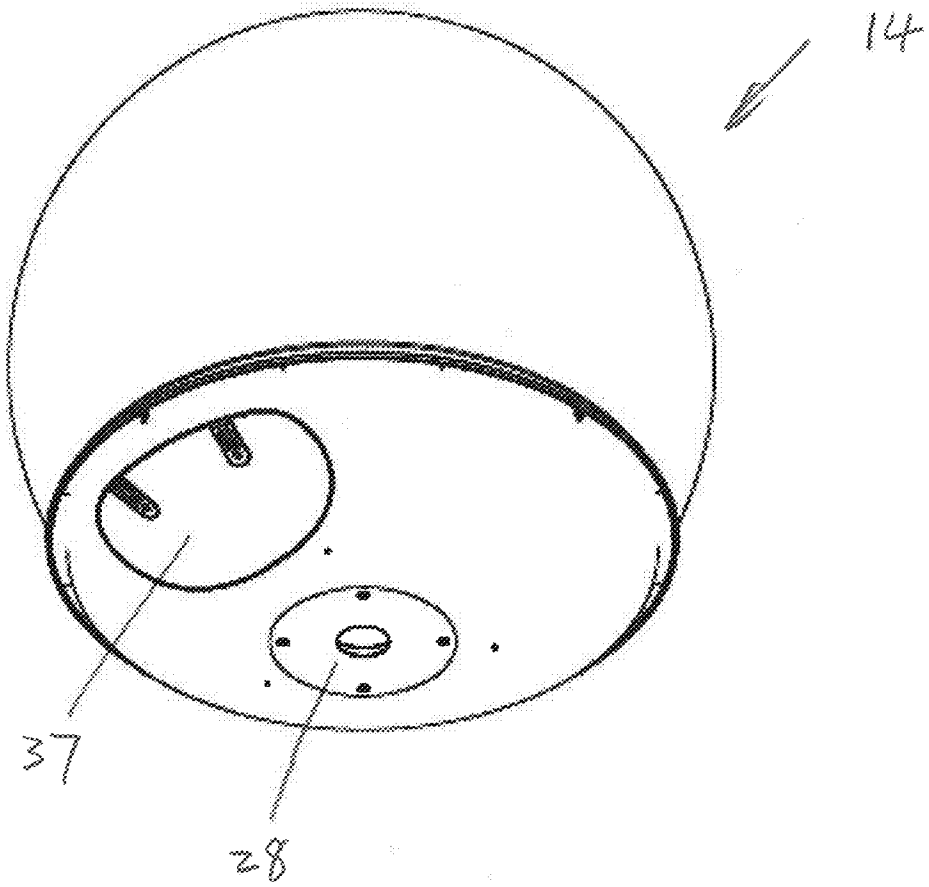
FIG. 8 is a bottom perspective view of the radome assembly of FIG. 6.

For securing the radome body 30, the base 27 is formed with a peripheral mount 29, to which the flange 33 of the radome body is affixed, as shown in FIGS. 6 and 8. The base is also formed with a pedestal mount 28 for supporting the pedestal. In addition, a hatch 37 is formed in the base for accessing the interior of the dome assembly. By using the hatch on the base, the dome body does not need to be removed during installation, repair or other operations inside the radome assembly.

To further minimize the loss of the radio waves due to the reflection and/or interference, the dome section 31, the waist section 32 and/or the flange 33 of the radome body 30 may be formed monolithically, for example, by molding. Monolithically formed radome body has other advantages. It may provide better seal and protection from hazardous environments. In maritime or other applications, better seals and protections for interior components of the antenna system are beneficial.

Once transmitted into the interior of the radome body 30, the radio waves are reflected by the reflector 11 to the focal point 12 and collected by the feed 15, 17 which is removably disposed in front of the reflector at the focal point. The feed sends the radio waves to the RF module 16, 18 which is operably connected to the feed. The RF module then converts the gathered radio waves to electronic signals for display or further processing.

Figure 9:
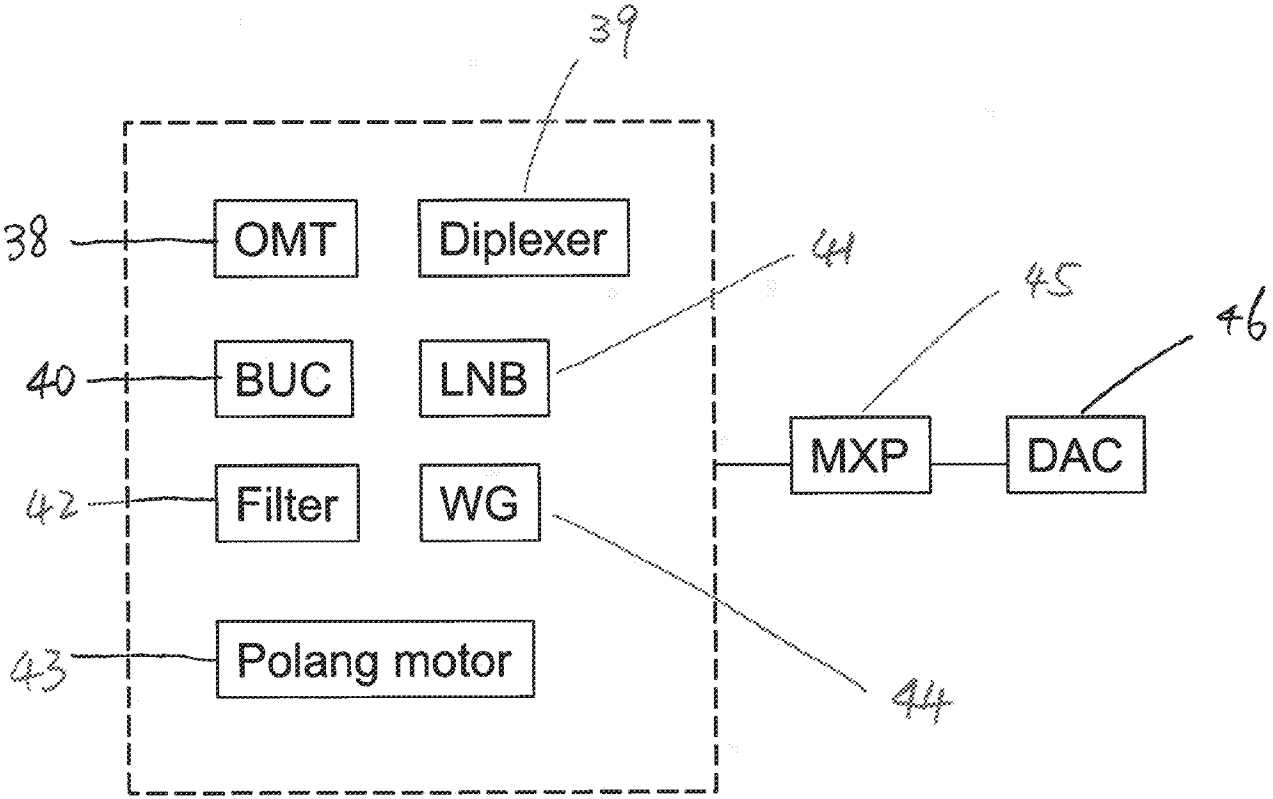
FIG. 9 is a schematic view of a RF module in use with a media exchange points and a digital antenna control unit.

As schematically shown in FIG. 9, a RF module generally includes an Orthomode Transducer (OMT) 38, a diplexer 39, a Block Upconverter (BUC) 40, a Low Noise Block-down-converter (LNB) 41, a filter 42, a Polarity Angle (Polang) motor 43, and/or a waveguide 44. Some RF modules may include multiple LNBs, filters and/or waveguides. For example, in order to receive both co-plane and cross-plane linear radio waves, a RF module may be equipped with two LNBs along with associated filters, waveguides, and/or other components.

In various embodiments of the present invention, the first RF module 16 is in a module configured for a first spectrum, for example, it may be a C or Ku band module, and the second RF module 18 is in a second discrete spectrum, for example, it may be a Ka band module. Accordingly the first feed 15 may be dimensioned and configured for use in a C or Ku band, and the second feed 17 may be dimensioned and configured for use in Ka band. Other components of the modules are also designed and tuned to the corresponding radio frequency range. One will appreciate that the present invention is not limited to the applications in C, Ku or Ka band, or in the RF range for satellite communication, and may be configured for use in other combinations of discrete spectra.

The RF module 16, 18 of the present invention may further be configured for use with a Media Exchange Points (MXP) 45, which in turn is connected to a digital antenna control unit (DAC) 46 for displaying signals in different formats such as in vocal and/or visual forms. The MXP is configured in accordance with the feed and the RF module and designed for use within the same target RF spectrum. That is, a Ku band MXP corresponds to a Ku feed and a Ku module; a Ka MXP corresponds to a Ka feed and a Ka module.

Figure 10:
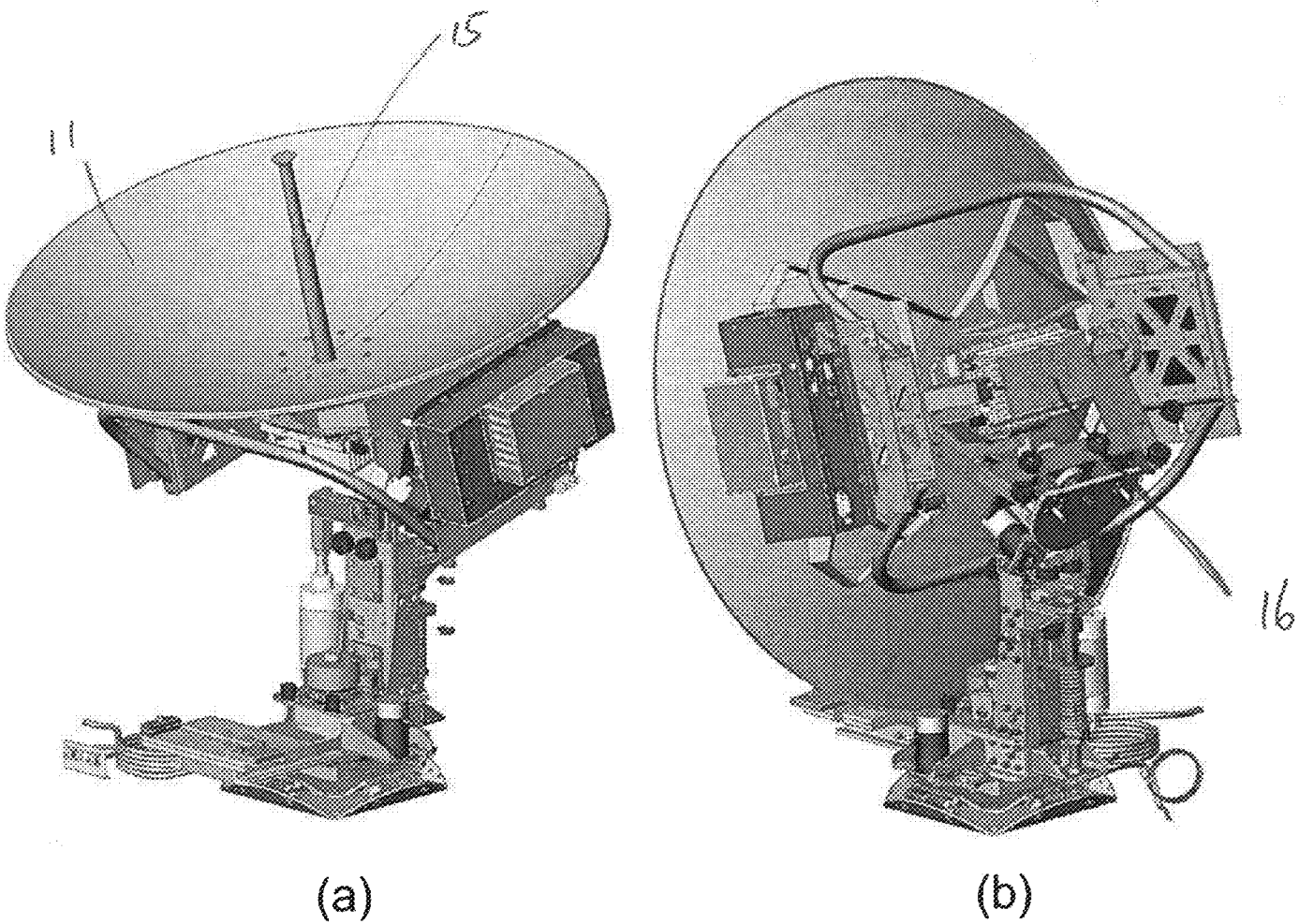
FIG. 10*a* is a front perspective view of the system of FIG. 1 without the radome assembly illustrating the first RF feed installed.
FIG. 10*b* is a rear perspective view of the system of FIG. 1 without the radome assembly illustrating the first RF module installed.
Figure 11:
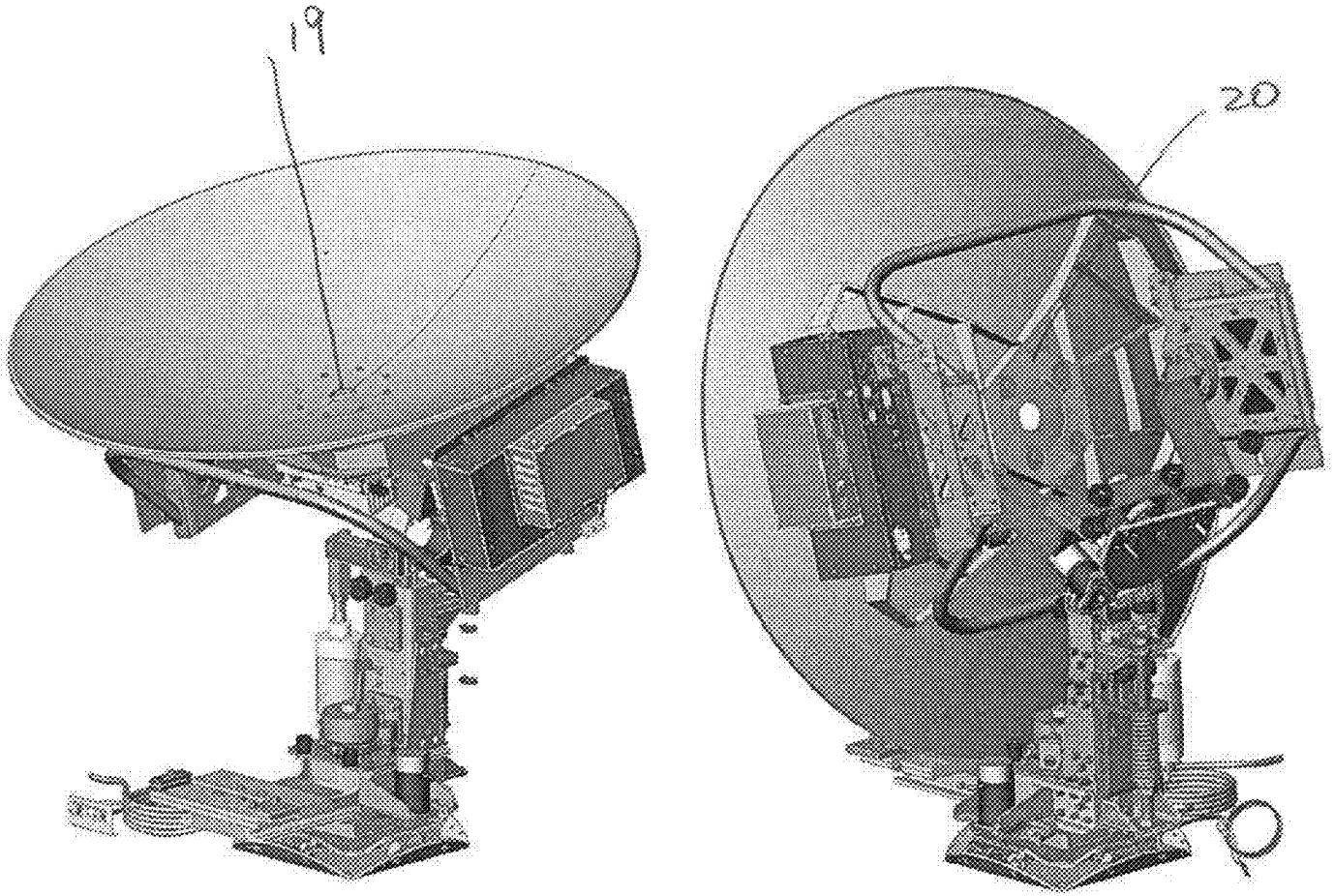
FIG. 11*a* is a front perspective view of the system of FIG. 1 without the radome assembly illustrating the first RF feed removed.
FIG. 11*b* is a rear perspective view of the system of FIG. 1 without the radome assembly illustrating the first RF module removed.
Figure 12:
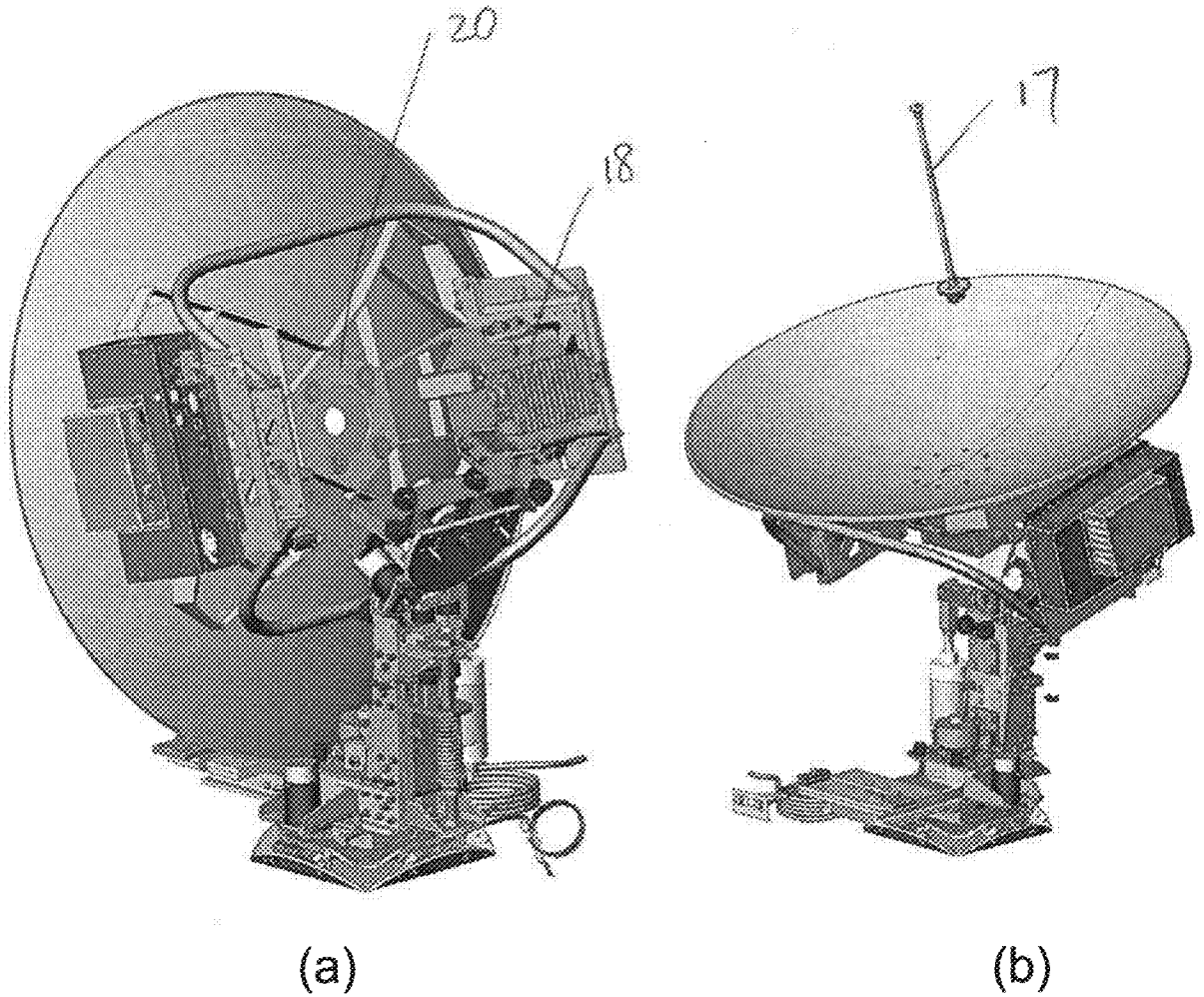
FIG. 12*a* is a rear perspective view of the system of FIG. 1 without the radome assembly illustrating the installation of the second RF module.
FIG. 12*b* is a front perspective view of the system of FIG. 1 without the radome assembly illustrating the installation of the second RF feed.
Figure 13:
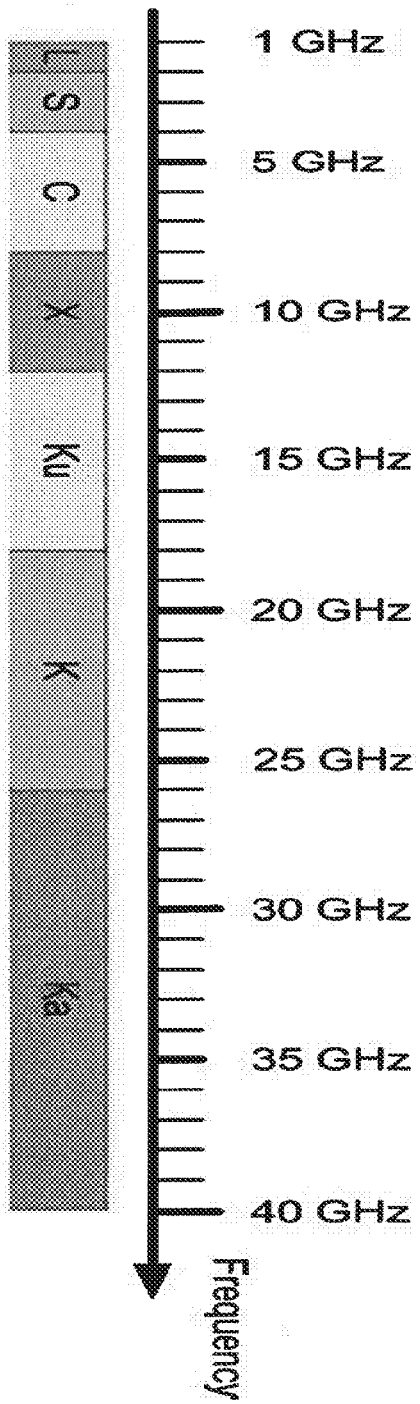
FIG. 13 shows typical radio frequency spectrums for satellite communication.

Hereinafter, an exemplary method utilizing the tracking antenna system 10 of the present invention in a plurality of discrete radio frequency (RF) spectrums will be explained with reference to FIGS. 10-12.

As shown in FIGS. 10*a* and 10*b*, the first feed 15 is disposed in front of the reflector 11 for gathering radio waves within the first discrete RF spectrum, and connected to the first RF module 16. In the illustrated embodiments, the first RF module is mounted on the back of the reflector, and converts the gathered radio waves to electronic signals.

In order to receive and convert radio waves in a different discrete RF spectrum, the first feed and module must be removed, as shown in FIGS. 11*a* and 11*b*. This can be done by removing the first feed first followed by removing the first module. Operations are simply, engaging operations such as unscrewing mechanical fasteners and/or unplugging electrical connectors.

After the first feed and module are removed, the second feed 17 and module 18 can be installed. Intermediate states of the installation of the second RF module and feed are shown in FIGS. 12*a* and 12*b* respectively. In the illustrated embodiments, the second RF module is installed on the back of the reflector before the installation of the second feed.

Once the installation of the second feed 17 and module 18 is complete and power is turned on, software embedded in the DAC 46 will automatically synchronize the system to the second of the plurality of the discrete RF spectrums, and point the reflector 11, through the motion control of the pedestal 13, in the correct direction towards the later desired satellite. The tracking antenna system of the present invention is now ready for satellite communication with the second satellite in a different RF spectrum.

As noted before, a plurality of protrusions 21 are formed in the module mount to safeguard the removal and installation of RF modules. With the protrusions in place, operation of switching RF modules from one to another is a simply task, easy and safe. Moreover, the hatch 37 formed in the base 27 provides a convenient access to the interior of the radome assembly 14. This allows the operation to be performed without removing the radome body 30.

Among significant advantages of the present invention are cost saving and convenience. As most of components of the present invention, for example, the radome assembly 14 and the module mount 20, are configured and adapted for use within the plurality of discrete RF spectrums, only the RF module and its associated parts need to be replaced, resulting in a tremendous cost reduction. The present invention also allows for switching to a more state-of-art module when it is in the market or when it is so desired.

For convenience in explanation and accurate definition in the appended claims, the terms "top", "bottom", or "interior", etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A tracking antenna system for use in a plurality of discrete radio frequency (RF) spectrums, the antenna system comprising:

a reflector for reflecting radio waves to a focal point;

a pedestal for supporting the reflector about a plurality of axes;

a radome assembly enclosing the reflector and the pedestal, the radome assembly being substantially transparent to radio waves within the plurality of discrete RF spectrums;

a first feed for receiving radio waves traveling from the reflector within a first set of one or more discrete RF spectrums, the first feed being removably disposed from in front of the reflector at or near the focal point;

a first RF module operably connected to the first feed for converting the received radio waves within the first set of one or more discrete RF spectrums to first electronic signals;

a feed mount for removably supporting the first feed, wherein the feed mount is dimensioned and configured to removably support a second feed for gathering radio waves within a second set of one or more discrete RF spectrums; and a module mount for removably supporting the first RF module, wherein the module mount is dimensioned and configured to removably support a second RF module for converting radio waves within the second set of one or more discrete RF spectrums to second electronic signals, wherein the module mount is coupled to the reflector, and wherein the module mount includes a protrusion extending from the reflector for allowing the first RF module or second RF module to be hung therefrom.

2. The tracking antenna system of claim 1, wherein the feed mount is on the reflector.

3. The tracking antenna system of claim 1, wherein the pedestal supports the reflector about three axes.

4. The tracking antenna system of claim 3, wherein the three axes include an azimuth axis, a cross-level axis, and an elevation axis.

5. The tracking antenna system of claim 1, wherein the radome assembly comprises:

a base having a pedestal mount for supporting the pedestal and a peripheral mount; and a radome body including a dome section, a substantially cylindrical waist section, and a flange extended from the waist section and removably secured to the peripheral mount of the base, wherein the dome section is substantially a sphere truncated a less half therefrom, and is tuned to be substantially transparent to the radio waves within the plurality of discrete RF spectrums.

6. The tracking antenna system of claim 5, wherein the waist section is configured to have a transition section formed of a plurality of plies for enhancing a strength of the radome body, wherein a leading edge of one ply is positioned ahead of or behind a leading edge of another ply immediately adjacent the one ply.

7. The tracking antenna system of claim 5, wherein the radome body is formed monolithically.

8. The tracking antenna system of claim 5, wherein the base further comprises a hatch for accessing an interior of the dome assembly.

9. The tracking antenna system of claim 1, wherein the first of discrete RF spectrums is a Ku band or a C band.

10. The tracking antenna system of claim 9, wherein the first RF module includes a first Orthomode Transducer (OMT), a first diplexer, a first Block Upconverter (BUC), a first Low Noise Block-downconverter (LNB), a first filter, a first Polarity Angle (Polang) motor, and/or a first waveguide.

11. The tracking antenna system of claim 9, wherein the first RF module is configured for use with a first Media Exchange Points (MXP) connected to a digital antenna control unit (DAC), and the second RF module is configured for use with a second MXP, for displaying signals in different formats include vocal and/or visual forms.

12. The tracking antenna system of claim 1, wherein the second of discrete RF spectrums is a Ka band.

13. The tracking antenna system of claim 12, wherein the second RF module includes a second OMT, a second diplexer, a second BUC, a second LNB, a second filter, a second Polang motor, and/or a second waveguide.

14. A tracking antenna system for use in a plurality of discrete radio frequency (RF) spectrums, the antenna system comprising:

a reflector for reflecting radio waves to a focal point;

a pedestal for supporting the reflector about a plurality of axes;

a radome assembly enclosing the reflector and the pedestal, the radome assembly being substantially transparent to radio waves within the plurality of discrete RF spectrums;

a first feed for receiving radio waves traveling from the reflector within a first set of one or more discrete RF spectrums, the first feed being removably disposed from in front of the reflector at or near the focal point;

a first RF module operably connected to the first feed for converting the received radio waves within the first set of one or more discrete RF spectrums to first electronic signals;

a feed mount for removably supporting the first feed, wherein the feed mount is dimensioned and configured to removably support a second feed for gathering radio waves within a second set of one or more discrete RF spectrums; and a module mount for removably supporting the first RF module, wherein the module mount is dimensioned and configured to removably support a second RF module for converting radio waves within the second set of one or more discrete RF spectrums to second electronic signals; and a cylinder assembly for damping vertical vibrations, the cylinder assembly connected to the pedestal via a universal joint.

15. The tracking antenna system of claim 14, wherein the universal joint is a ball joint.

16. The tracking antenna system of claim 14, wherein the radome assembly comprises:

a base having a pedestal mount for supporting the pedestal and a peripheral mount; and a radome body including a dome section, a substantially cylindrical waist section, and a flange extended from the waist section and removably secured to the peripheral mount of the base, wherein the dome section is substantially a sphere truncated a less half therefrom, and is tuned to be substantially transparent to the radio waves within the plurality of discrete RF spectrums.

17. A method of converting a tracking antenna system for use in a plurality of discrete radio frequency (RF) spectrums, the method comprising:

providing the tracking antenna system of claim 14;

removing the first feed from the feed mount;

removing the first RF module from the module mount;

installing the second RF module on the module mount that is dimensioned and configured to removably support the second RF module; and installing the second feed on the feed mount that is dimensioned and configured to removably support the second feed.

18. A method of converting a tracking antenna system for use in a plurality of discrete radio frequency (RF) spectrums, the method comprising:

removing a first feed from a feed mount, wherein the first feed gathers radio waves within a first of discrete RF spectrums reflected from a reflector of the tracking antenna system;

removing a first RF module from a module mount, wherein the first RF module is operably connected to the first feed, and converts the radio waves within the first of discrete RF spectrums to electronic signals, wherein the module mount is installed on the reflector and includes a protrusion extending from the reflector for hanging the first RF module;

installing a second RF module on the module mount that is dimensioned and configured to removably support the second RF module; and installing a second feed on the feed mount that is dimensioned and configured to removably support the second feed, wherein the second feed gathers radio waves within a second of discrete RF spectrums, and the second RF module converts the radio waves within the second of discreet RF spectrums into second electronic signals.

19. The method converting a tracking antenna system of claim 18, wherein the first of discrete RF spectrums is a Ku band or a C band.

20. The tracking antenna system of claim 18, wherein the second of discrete RF spectrums is a Ka band.

21. The tracking antenna system of claim 18, wherein the removing and installing steps are completed through a hatch on a base of the radome assembly without removing the radome assembly.

* * * * *